United States Patent [19]

Bachmann et al.

[11] Patent Number: 4,459,733

[45] Date of Patent: Jul. 17, 1984

[54] METHOD AND DEVICES FOR ASSEMBLY OF HELIXES INTO FACE STRUCTURES

[76] Inventors: Wolfgang Bachmann, Wingertstr. 12, 6072 Dreieich; Dieter Spahn, An der Mainbrücke 14, 6450 Hanau, Steinheim, both of Fed. Rep. of Germany

[21] Appl. No.: 269,788

[22] Filed: Jun. 2, 1981

[30] Foreign Application Priority Data

Jun. 7, 1980 [DE] Fed. Rep. of Germany ..... 3021562

[51] Int. Cl.[3] ..... B23P 19/04

[52] U.S. Cl. ..... 29/433; 29/33 F; 29/821; 140/3 R; 226/62

[58] Field of Search ..... 29/433, 241, 821, 33 F, 29/564.2, 564.6; 226/62, 63, 72, 112, 147, 149, 150, 158, 162; 245/6; 140/3 A, 3 R, 92.6; 198/848, 850, 851

[56] References Cited

U.S. PATENT DOCUMENTS 2,103,918 12/1937 Guba ..... 245/6

2,255,452 9/1941 Pink ..... 245/6

*Primary Examiner*—Francis S. Husar

*Assistant Examiner*—Linda McLaughlin

*Attorney, Agent, or Firm*—Michael J. Striker

[57] ABSTRACT

Helixes are assembled into face structures by providing an initial helix which is stretched and retained on a work table, and a first helix which is attached to the initial helix, inserting into the first helix of a pre-stretched second helix by means of a joining tool and from a discharge conduit so that the second helix exits from the discharge conduit at an acute angle with respect to the first helix and moved along the latter connecting the second helix with the first helix by inserting an insert wire into the overlapping areas between the head arches of the first and second helixes, and displacing the thus finished face structure by a predetermined distance between insert wires in a timed sequence before a subsequent such inserting step for a further helix to be inserted into the second helix.

43 Claims, 14 Drawing Figures

90
12
12a
25
91
92
A
77
79
78
80
81
76
26
0
1
2
13
60
75
43
42
42a
19
18
65
2
75a
41
69
71
67
21
68
66
70
73
72
20
74
23
24
16

METHOD AND DEVICES FOR ASSEMBLY OF HELIXES INTO FACE STRUCTURES

BACKGROUND OF THE INVENTION

The invention relates to a method and device for assembly of helixes made from metal wire or plastic wire, respectively, into face structures like, cloths, mats, screens, or the like, by means of plug-in wires made of metal or plastic, respectively, which are introduced into the overlapping areas between the head arches of two assembled left or right directed helixes or helixes which are in a straight direction.

Such face structures are used in many areas of technology. Face structures made from helixes are used, preferably in conveyor belts, for example, in drying furnaces, baking ovens, candy transport devices, but also in the fishing industry, in packaging machines or for transporting foodstuff of any type, respectively.

Face structures made from plastic wire helixes may preferably be used as conveyor belts at normal temperatures, for example, in the paper making industry, preferably as a replacement for expensive felt conveyor belts. Face structures of the mentioned type may also be used as felt mats or screens.

The measurements of such face structures vary and depend on the given type of use. While filter mats, screens, or the like require small belts, the transport belts for paper making may have dimensions of 10 meters or more.

Hitherto, such face structures were made manually in a very expensive manner. On a work table, which corresponds to the width of the face structure, the partially finished face structure is placed and which drops behind the work table onto the supply container or on the floor, respectively. On the last present helix of the exemplified 8 meter wide face structure the last added helix is mounted by means of an insert wire which is inserted in the overlapping area of the helixes which penetrate with one another. Thereby, this latter added helix is stretched in such a manner that the subsequent helix can be inserted into the intermediary spaces without any difficulties. Immediately, after the joining, the insert wire is inserted by a second person in most cases.

Even if the persons being occupied with such a manufacturing obtain a certain skill, the total way of making face structures of the aforementioned type is expensive and, above all, time consuming. They cannot be ordered on a rush basis when a transport belt is not operable in the papermaking machine. In order not to leave such an expensive machine idle for an inadequate long time, at least one conveyor belt should be available in reserve.

In order to eliminate interfering spring-like pretension which these face structures have after the helixes are assembled in the described face structures, it had been suggested to use torsion free helixes and to thermically fix the face structure, for example, a screening belt, after inserting the insert wire in the stretched condition. In addition, helixes with broadened helix bends are used, whereby they are so arranged that they are in a laterally offset position superimposed to each other before the assembly. Thereby, the helixes are stretched somewhat lengthwise and guides the same through two pressure rollers, thus pressing them together. The widened helix bends hold the assembled helixes together after the exerted pressure thereon is released, so that the insert wire can be inserted (DE-OS 2 938 221).

Even if the manufacturing of such face structures is slighly improved, the operating steps still must be performed manually. The disadvantage of required personnel and time consumption remains.

SUMMARY OF THE INVENTION

It is therefore an object of the invention to overcome these disadvantages and to provide a joining method as well as a corresponding joining tool whereby the manufacturing of such face structures of any given width and an exact maintaining of the given inclinations of the helixes are substantially accelerated and, above all, are automated.

It had been found that this can be achieved in a simple manner in that into one already present helix which is stretched and retained on a work table together with a recently attached first helix, the prestretched second helix is inserted by means of a joining wheel, whereby the second helix exiting in an acute angle with respect to the first helix from the discharge conduit is moved along the first helix, that the insert wire is following joining tool, and that in a timed sequence between a finished and a subsequent further joining operation the face structure is further transported in the same or the opposite direction by one insert wire distance.

Due to the translatory movement of the joining tool in conjunction with its operating mode and the discharge of the second prestretched helix in an acute angle to the first helix it is achieved that not only a relative simple joining tool may be used but that the joining can be performed purely mechanically with a hitherto not believed speed.

Due to the skillful design possibilities of the joining tool, the after guiding of the insert wire can be performed rapidly and without any problems.

Between a finished and a subsequent further joining operation in the same or the opposite direction, not only the face structure is timely moved by one insert wire distance, but also the required switching over of the joining method is performed. It is of particular advantage that the joining method can be realized by joining devices which operate pneumatically. Without changing the gist of the invention, the pneumatically triggered operating steps may be performed electromagnetic, electromechanical or mechanically. The inventive joining method permits that, for example, a joining wheel is guided in a reciprocal direction with respect to the work table, for example, by a chain or rope drive around the work table. In this manner of performing the method, the face structure may be joined at both longitudinal sides of the work table.

In order to obtain a full use of the joining possibilities, a joining wheel for joining during the reciprocal feeding is combined with two oppositely inclined discharge conduits from which a left helixed and a right helixed helix are discharged, in a further embodiment of the invention.

Due to another helix being inserted into an already available helix on the face structure, the latter is always pretensioned in a correct manner. If a new machine is to be prepared for making the face structure of the type discussed, a first helix must be correctly tensioned on the work table having the correct stretch. Only for preparing the joining device in accordance with the inventive method is it required to make the beginning of the face structure manually.

In accordance with a further inventive idea it is provided that the beginning of the second added helix is retained by the end of the first helix at the beginning of a joining cycle, and that the transport speed of the joining tool and the feeding speed of the given second helix is so synchronized with each other, so that the necessary stretching of the second given helix is obtained.

The flattening of the helixes or the edge mounting on the face structure are performed in further method steps which are not a part of this invention.

For carrying out the method of the invention, the joining device is characterized in that the joining tool and the discharge conduits are provided on a joint carriage which is reciprocably moveable above the working table across the total width thereof, in such a manner that the distance between the lower area of the joining wheel and a jointing element such as a jointer or a jointer table disposed on the work table is somewhat lower than the cross section of the helix, so that a supply roller, as well as a wire insert device are provided for the insert wire, and that for transporting the face structure by a wire insert distance, a transport device is provided with a lower pneumatically actuable transport piece and an upper counter retainer. Thereby, a safe insertion of the added second helix is obtained even when making arbitrarily wide face structures and also one achieves a sufficient automatic operation of the device.

Each supply container is coupled through a supply conduit as well as a deflection or pressure roller, respectively, with the discharge conduit which exits in an acute angle from the lower edge of the joint carriage.

In one embodiment of the invention the supply conduits are guided in an operating wall of the joint carriage on both sides around the joining tool, and that the discharge conduits are combined on the lower edge of the joint carriage below the joining tool.

This provides for an exceptionally simple construction of the joint carriage.

Each supply conduit is provided with a preferably pneumatic actuated cutting device, the distance of which corresponds to the opening of the associated discharge conduit, the length of the overrun of the operating stroke. The end of the second helix still exists from the discharge conduit, after the cutting operation. At this time the joint carriage executes its overrun stroke. After returning from this overrun stroke to the place at which a new joining operation starts, the beginning of the helix which is ready for the next joining operation moves from the cutting device to the discharge opening of the discharge conduit and is thereby ready at the beginning of the joining operation without any other auxilliary means.

It is advantageous in one embodiment that the joining tool is a joining wheel which is rotatably mounted on a drive shaft in such a manner that its jacket face which is designed as a joining edge extends into the common discharge area of the two discharge conduits. The jacket face of the joining wheel may be differently designed, such as for example made smooth, indented with respect to the drive shaft, provided with serrations, points, teeth.

In accordance with the invention it is possible to carry out the transport of the joint carriage which is provided with one or two joint carriages in a reciprocating or a circular operation. However, it had been found that it is advantages to provide a gear rod for the transport of the joint carriage in that a gear rod is mounted below the bottom of the joint carriage on a support between parallel disposed sliding rods on a working table plate of the working table and which engages a drive gear which is driven by a drive motor and is mounted on the joint carriage. This drive motor drives the joining wheel as well as the tooth gear. Since the drive motor is controllable, the advance speeds of the carriage and the rotation of the joining wheel are always exactly synchronized with each other.

At the work table of the joining wheel at least one wire plug in device is provided for the plug in wire. During a reciprocal operation a wire plug in device with a supply roll for the insert wire is provided on each end of the work table in accordance with the invention. The wire guide and the insert drive may be preferably adjusted on the work table in the area of the overruns.

In order to assure an insertion of the insert wire, an ultrasound oscillator may be provided through which the insert wire is brought into high frequency oscillations before being introduced into the overlapping area.

After the ultrasound oscillator, the insert wire is guided through an apertured knife which cuts the insert wire to the correct length, preferably pneumatically.

A safe joining and a correct insertion of the insert wire into the overrun area is advantageously obtained in that a device is provided which extends across the total width of the working table for retaining and aligning of helixes placed on the jointer or jointer table.

In a first embodiment, alignment knives are provided for retaining and aligning of the helixes over the total length of the work table. In a specific width of the work table the individual alignment knife may be provided with adjacent smaller alignment knives.

The adjustment knife or knives, respectively, are guided in a vertical direction with respect to the working table and are under the influence of springs which push the cutting edges of the alignment knives onto the overlapping area of the helix which is present and on the latter inserted helix. Normally, the alignment knives are lifted during the feeding of the face structure against the force of the springs due to their yielding support. In a particular embodiment the alignment knives may be coupled to a pneumatic stroke drive which lifts the alignment knives when the face structure is transported further by one insert wire distance.

When using alignment knives, a transport device with a lower pneumatic actuable transport piece and an upper counter retainer is provided for transporting the face structure of about one insert wire distance.

In a further embodiment of the invention for aligning, retaining and transporting a face structure during and after a joining operation a pneumatically driven yielding pin bar is provided which extends across the total width of the work table.

Instead of the joining wheel a sliding wheel on the end of a yielding arm is used as the joining tool.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

Examples of embodiments of the invention will be explained in detail in accordance with the following drawing.

It shows.

DESCRIPTION OF THE PREFERRED EMBODIMENTS

Figure 1:
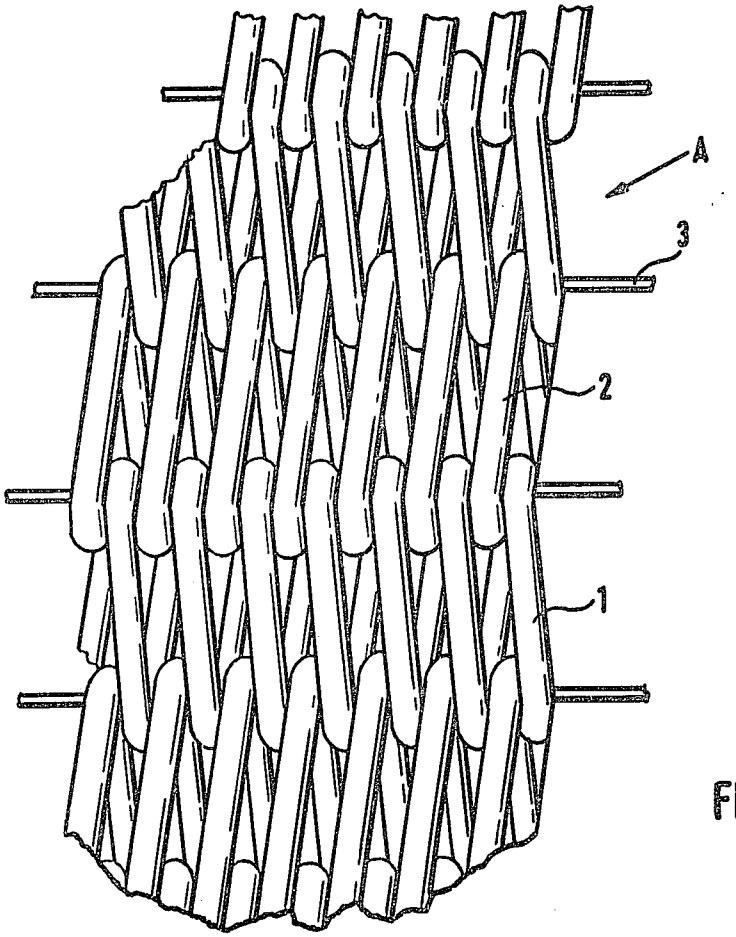
FIG. 1 a plan view onto the cutout from a face structure.
Figure 3:
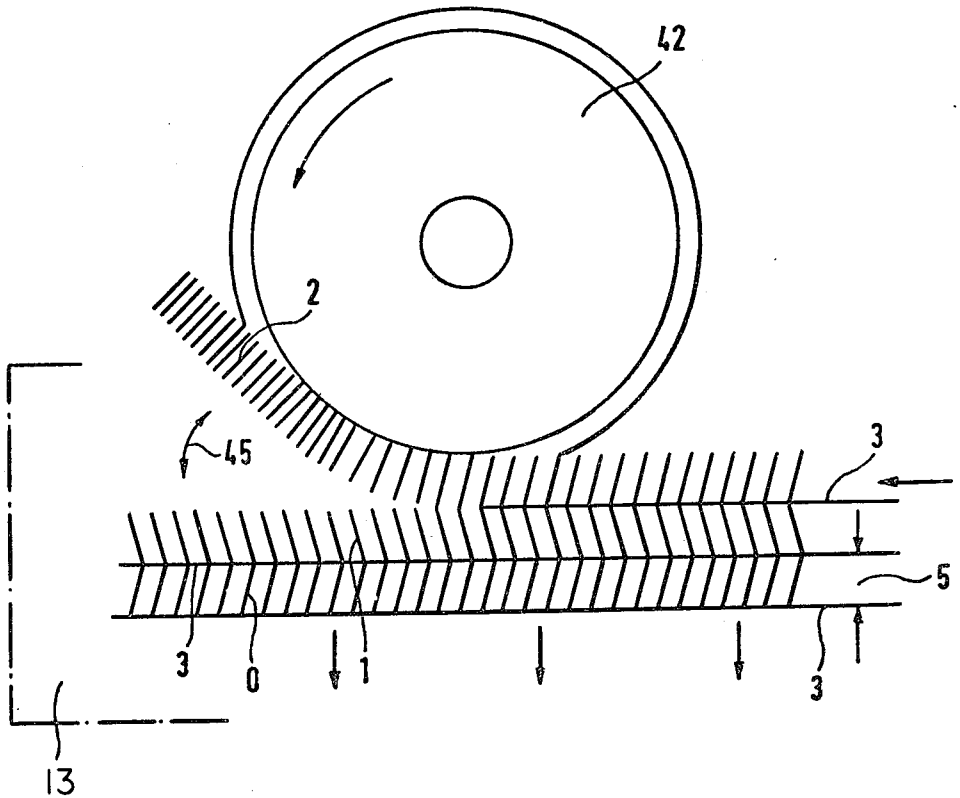

For illustration purposes FIG. 1 shows a plan view onto the cutout from a face structure A, which is made in accordance with the inventive device. In its finished stage, the face structure A consists of a more or less amount of helixes made of metal wire or plastic wire which are held together by means of insert wires made of metal or plastic. Two adjacent helixes are designated with the numeral references 1 and 2 in FIG. 1. During the further course of the description, the basis is an existing helix 0 which is connected with the face structure by means of an insert wire 3. FIG. 3 schematically indicates this. The so-called last added first helix 1 is added to the existing helix 0 and which is connected with the existing helix 0 by the insert wire 3.

In accordance with FIG. 3, the opposite side of the last added first helix 1 is open. It is clearly recognizable that the helix 1 is so tensioned by the existing helix 0 that the individual windings of the helixes form intermediary spaces into which the windings of the added second helix 2 can be easily inserted.

Figure 2:
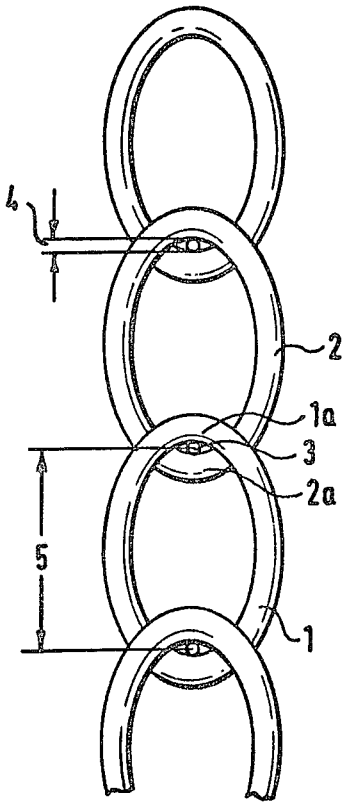
FIG. 2 a simplified side view onto the helixes of the face structure in accordance with FIG. 1, FIGS. 3 and 3*a* are schematic views of the joining operation, FIG. 4 a view onto the joining carriage-side of the joining tool FIG. 5 joint carriage FIG. 6 a cross section along line VI—VI, according to FIG. 4, FIG. 7 details of a retaining and transport device for face structures, FIG. 8 details of another embodiment of a retaining and transport device, FIG. 9 a view in direction A' onto the retaining and transporting device according to FIG. 8, FIG. 10 a wire inserting device, FIG. 11 a sectional view along line A-B in FIG. 10 and, FIGS. 12 and 13 are a side view and a front view of running jacket faces of the joining tool.

FIG. 3 shows a joining tool 42 and a jointer 13, so as to demonstrate the mode of operation of the new joining device. Above the joining tool 42, which in the shown embodiment is designed as a joining wheel, the direction arrow of the translatory direction is shown. Within the joining tool 42 the arrow indicates the direction of rotation of the tool. It can be clearly seen that the helix 2 to be added is inserted into the first helix 1 by the joining tool. Thereby, the insert wire 3 follows the joining tool. As can be seen from FIG. 2, the insert wire 3 is inserted in the overlapping area 4 between the tow head arches 1*a* and 2*a* of helixes 1 and 2. FIG. 2 also shows the so-called insert wire distance 5 by which the face structure A, according to FIG. 3, is further moved in the direction of three downwardly pointing arrows, after finishing the joining operation. It is important that the added second helix 2 is inserted in an acute angle 45 with respect to helix 1 by joining tool 42. In the practical performance the added helix 2 exits from a discharge conduit, not shown in FIG. 3, in which it is not yet stretched.

Figure 3A:
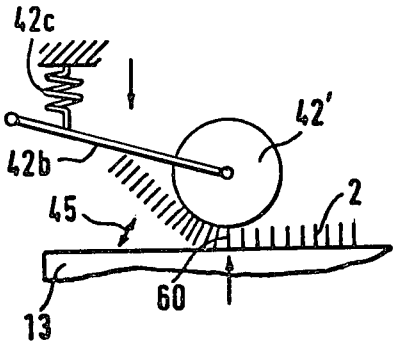

FIG. 3*a* shows a joining wheel 42' which has an arm 42*b* connected with a spring 42*c*.

The helixes to be joined, as can be seen in particular from FIGS. 1 and 3, may be alternately directed to the left or the right. However, without changing the gist of the invention, evenly directed helixes may also be joined with the invention.

In the practical application of the joining method indicated in FIG. 3, the joining tool 42, in the shown embodiment the joining wheel, is so connected with the device that it can be transported in a reciprocal movement for joining. In this case two inclined discharge conduits are combined with the joining tool 42.

For providing the added second helix 2 with the required stretching so that its helixes can be easily inserted into the intermediary spaces of the helixes of helix 1, the beginning of the added second helix 2 is retained by the end of the first helix at the beginning of a joining cycle. This is simply done in that the beginning helixes of helix 2 are inserted into the intermediary spaces of the helixes of helix 1. The transport speed of the joining tool 42 and the supply speed of the second helix are so synchronized with each other in accordance with the invention, that by this synchronization and by the retaining of the helix beginning the required stretching of the added helix 2 is carried out automatically (FIG. 3).

Figure 4:
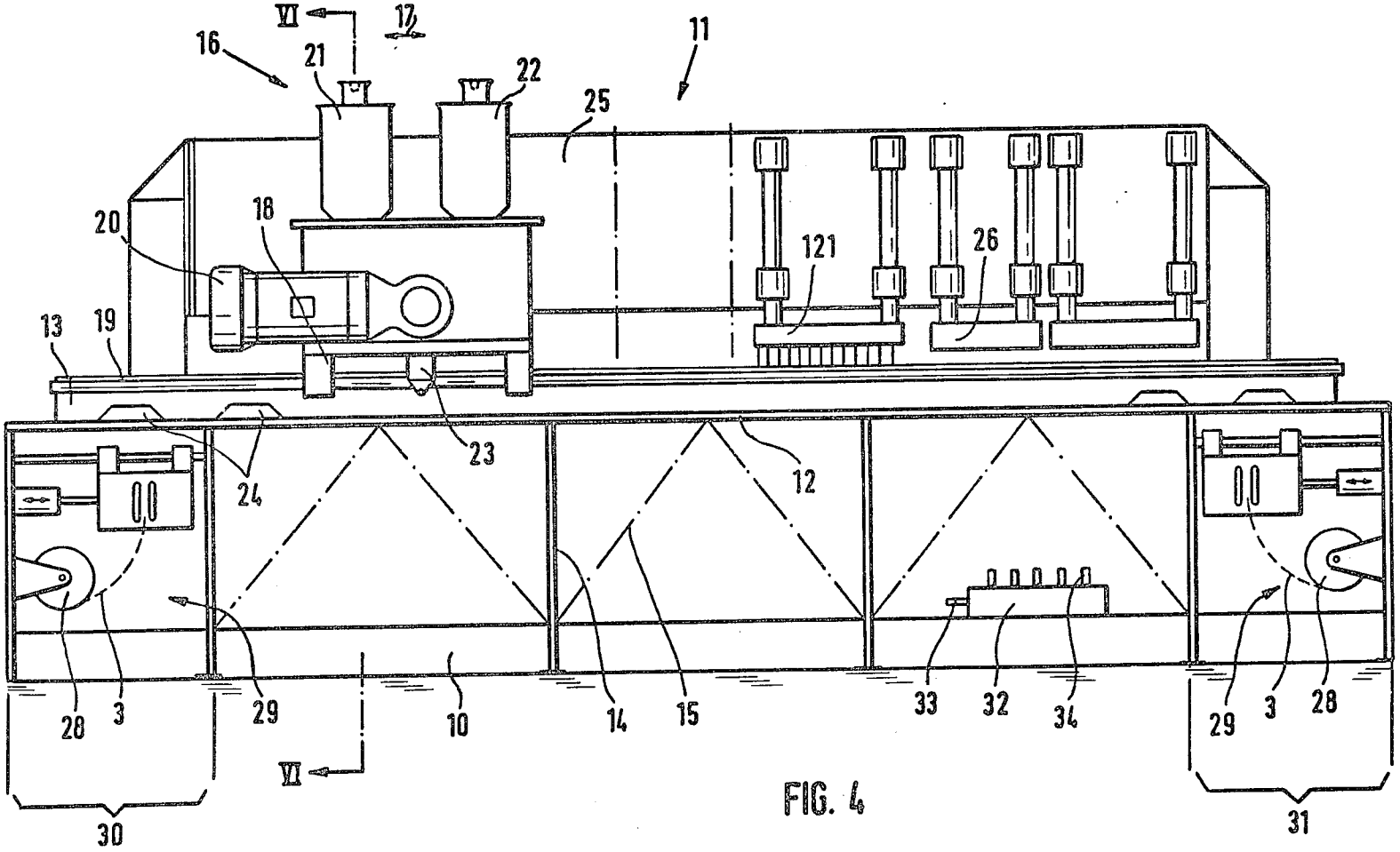

FIG. 4 shows a view of the joining device, seen from the side of the joint carriage, in accordance with the invention. On a bottom 10, a work table 11 with feet 14 and reinforcements 15 is installed which in the shown embodiment is provided with a work table plate 12 and a jointer 13 mounted thereon. In the direction of arrow 17, a joint carriage 16 can be reciprocately moved across the total width of the work table by means of sliding feet 18 on sliding rods 19 and driven by a drive motor 20. The operating stroke of the joint carriage 16 is practically as long as the reinforcement bridge 25. A left overrun 30 and a right overrun 31 are provided in front and rear of this reinforcement bridge 25, the importance of which will be explained later.

A left helix supply container 21 and a right helix supply container 22 are mounted on the joint carriage in which the helixes to be fed are stored. At least one switch 23 is mounted on joint carriage 16 which is actuated by adjustable trigger 24.

Alignment knives 26 are provided on the right side of bridge 25 which provide for an exact retention of face structure A during the joining operation. Instead of alignment knifes 26, pin bars 121,126 may be used. Wire insert devices 29 are provided in the overrun areas 30 or 31, respectively, which are provided with a supply roll 28 for the insert wire 3, as well as a transport device for the insert wire 3 which which will be explained later.

In the shown embodiment in accordance with FIG. 4 the joining tool is pneumatically driven. For this purpose, a pneumatic distributor 32 is provided to which compressed air is fed through an input nipple 33 which then is fed through rigid or flexible lines 34, respectively, to the individual pneumatic switching stations.

It is to be understood that FIG. 4 represents only one possible embodiment of the joining device in accordance with the invention. Depending from the width of the face like structure to be joined, the joining device may constructively be designed differently. In principle, each inventive joining device is provided with a joint carriage 16, alignment knives 26 or pin bars 121, 126, respectively, as well as wire insert devices 29. In addition a transport device for the face structure A is provided which is not shown in FIG. 4. The face structure is discharged in a device in accordance with FIG. 4 on the opposite side of joint carriage 16.

Figure 5:
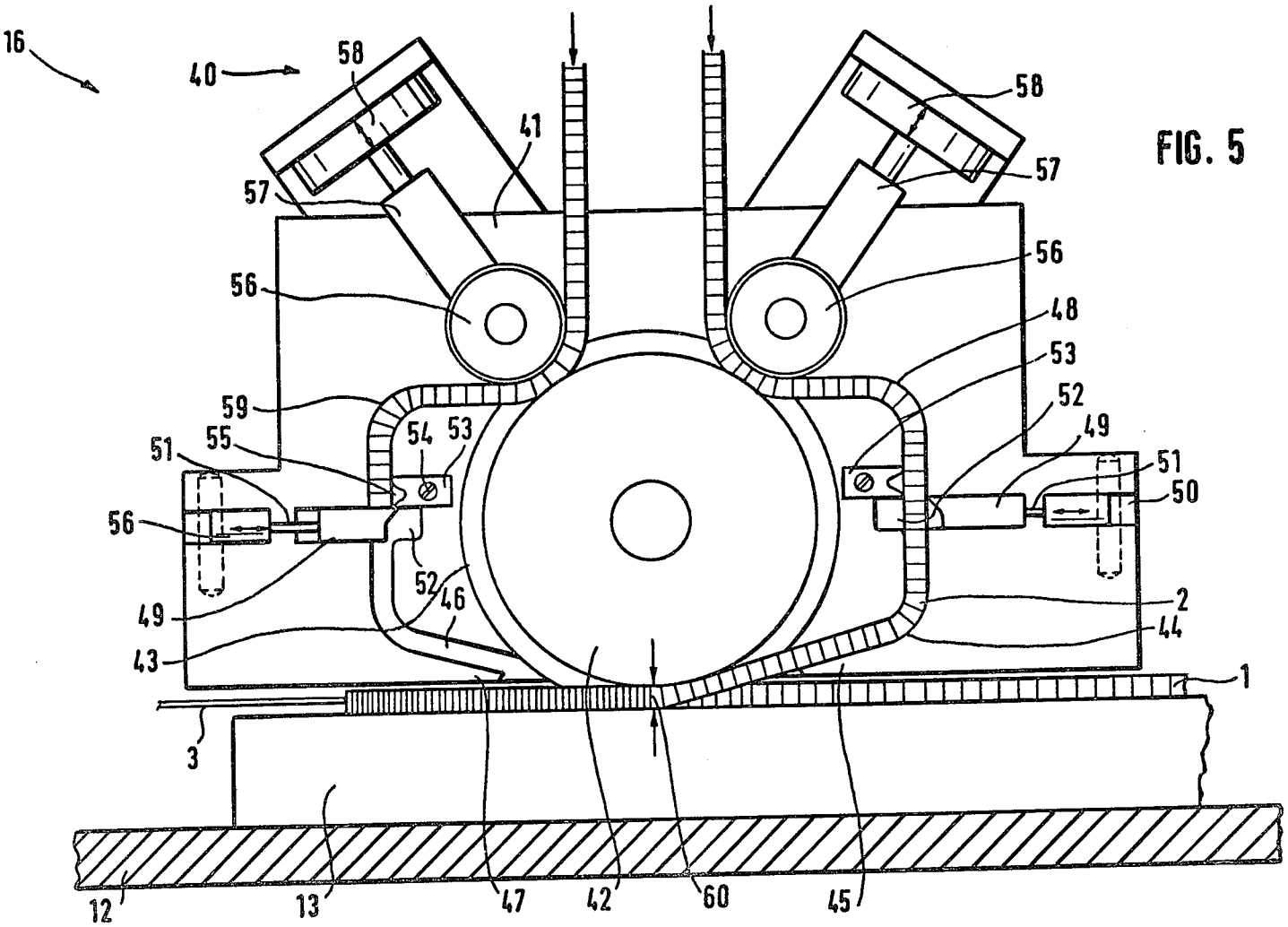

FIG. 5 shows, partially in a sectional view, the embodiment of a joining tool. The joining device is indicated by the work table plate 12 on which the jointer 13 is mounted on which the last inserted first helix 1 and the second added helix 2 can be seen. The insert wire 3 is shown on the left half of FIG. 4.

The joining tool 42 together with the joint carriage 16 is transported in the direction of arrow 40.

Figure 6:
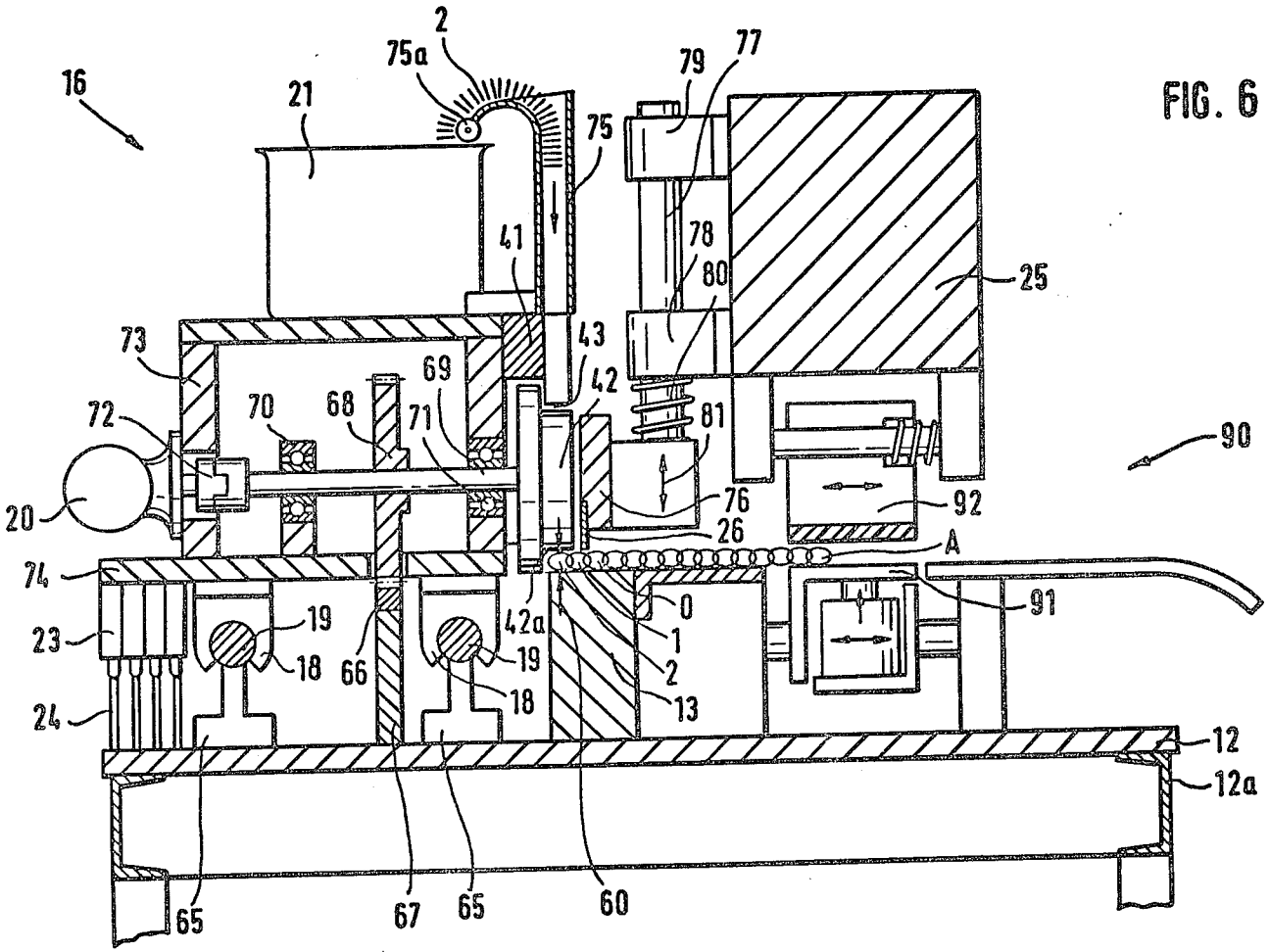

The joining tool 42 with a circumferential annular slot 43 is mounted in an operating wall 41. FIG. 6 shows this arrangement in a cross section. FIG. 6 also shows that the joining tool 42 is coupled with a drive shaft 69 which is coupled on the drive motor 20 by means of a coupling 72.

The operating wall 41 is provided with a right discharge conduit 44 and a left discharge conduit 46. Both are arranged in an acute angles 45 and 47 with respect to the jointer 13. The lower opening of the discharge conduits 44 and 46 end below joining wheel 42, the lower area of which forms a distance 60 with respect to the upper face of jointer 13. Adjacent to the discharge conduits 44 or 46, respectively, feeding conduits 48 or 59, are provided wherein arresting knives 49 are provided.

The arresting knives 49 are disposed in the joining feeding conduits 48,59 and the discharge conduits 44,46 which are guided on both sides around the joining tool 42 and are worked into the operating wall 41 of the joining carriage 16. The distance of each cutting device formed by arresting knife 49, and associated counter cutting edge 53 from the opening of the associated discharge conduit 44,46 on the lower edge of the joint carriage 16 corresponds to the length of the associated overrun 30 or 31 of the operating stroke. The arresting knife 49 of each cutting device is driven by a pneumatic operating cylinder 50 which is adjustably mounted in the operating wall 41 of the joint carriage 16. Each pneumatic drive cylinder 50 is in effective connection with the arresting knife 49 by means of an intermediary rod 51. Each arresting knife has a cutting edge and a face which retreats therefrom so that a free space 52 is created with respect to the operating wall 41, so as to prevent a jamming of the end of the discharging helix 2. Opposite to arresting knife 49 is a counter cutting edge 53 which is mounted on the operating wall 41 by means of an adjustment screw 53. The counter cutting edge 54 also is provided with a free space 55 which prevents a jamming of the beginning of the helix which remains in the feeding conduit 48 or 59, respectively.

Pressure rollers 56 provided on the bends of feeding conduits 48 or 59, respectively, are in positive connection by means of a roller support 57 with pneumatic pressure cylinders 58.

The arresting knife 49 of the one feeding conduit 48 or 59, respectively, and the pressure roll 56 of the other feeding conduit 48 or 59, respectively, are alternately actuable. By moving the pressure roller 56 to the helix 2, the helix can be fed. In a particular embodiment the pressure roller 56 may be driven by the drive motor of the joining tool 42, or the like, and if need be.

As can be seen, in particular from FIG. 6, the joining tool 42 is rotatably mounted on a drive shaft 69 supported in bearings 71, in such a manner that its jacket face **42*a* which is in form of a joining edge extends into the common discharge area of the two discharge conduits 44, 46 and there it maintains a distance 60 to the surface of jointer 13** which is smaller than the cross section of a helix.

Figure 13:
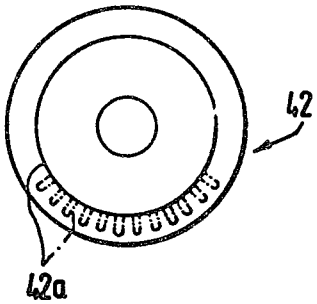
Figure 12:
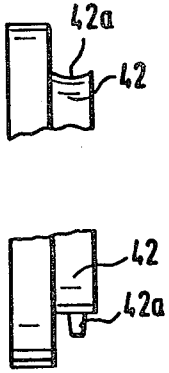

From FIGS. 12 and 13 it can be seen that the face **42*a* of the joining tool 42 is smooth, but may be arched, or serrated or may be provided with teeth or points with respect to drive shaft 69. The joining tool 42 may also be mounted exchangeably on drive shaft 69, so as to use the optimum face 42*a*** when joining face structures A.

In accordance with FIG. 6 the work table 12 is made safe against bending by means of longitudinal supports **12*a*. It can be clearly seen that the joint carriage 16 in front of jointer 13 is moveably mounted by means of sliding feet 18 on sliding rods 19 which are supported on supports 65 which in turn are mounted on work table 12**.

Between the sliding rods 19, a gear rod 66 can be seen which is supported on a support 67 and which cooperates with a drive gear 68 which is mounted on drive shaft 69. The drive shaft 69 is coupled with the drive motor 20 by means of a coupling 72. Normally, the drive motor is an electromotor the speed of rotation of which is controllable. Due to this logical arrangement one achieves that the advance drive of the joint carriage 16 is always in a direct rigid cooperation with the rotational speed of the joining tool 42. Therefore, the joining tool 42 has always the correct suitable joining tool speed for each joining speed.

The drive shaft 69 is mounted in an intermediary bearing 70 and a bearing 71.

FIG. 6 clearly shows in a cross section the design of operating wall 41 and the joining tool 42 with its joining edge **42*a*, as well as the annular slot 43 surrounding the joining tool. The joint carriage is completed by a rear wall 73 and a bottom 74. Below the drive motor 20 on the lower side of bottom 74, switches 23 are provided which coact with the adjustable triggers 24. The switches 23** trigger electrical or pneumatic operations.

At first the helix 2 is disposed in the helix supply container 21. The helix is fed from a helix supply 75 and an auxilliary roller **75*a* to the feeding conduits 48 or 59**, respectively.

The right half of FIG. 6 shows the face structure A with the existing helix 0, the last added first helix 1 and the further added second helix 2. FIG. 6 also clearly shows an alignment knife 26 which is yieldingly mounted on the bridge 25 with the assistance of the support 76, a sliding rod 77, as well as sliding bushings 78 and 79. Following the force of a spring 80, the alignment knife 26 is pressed onto the two joined helixes 0 and 1 above the overlapping area 4. The directional arrow 81 indicates how the alignment knife is moveable. Depending on the design of spring 80 the alignment knife 26 can automatically escape upwardly during the advance of face structure A, or may automatically penetrate into the recess between two joined helixes, or may be lifted or lowered after a finished joining cycle during the transport step of face structure A by a pneumatic stroke device, not shown.

The transport of the face structure A is carried out by a transport device 90 which is provided with a lower pneumatically actuated transport piece 91 and an upper counter retainer 92. The lower transport piece 91 cannot only be driven pneumatically, but also electrically or electromechanically.

Figure 7:
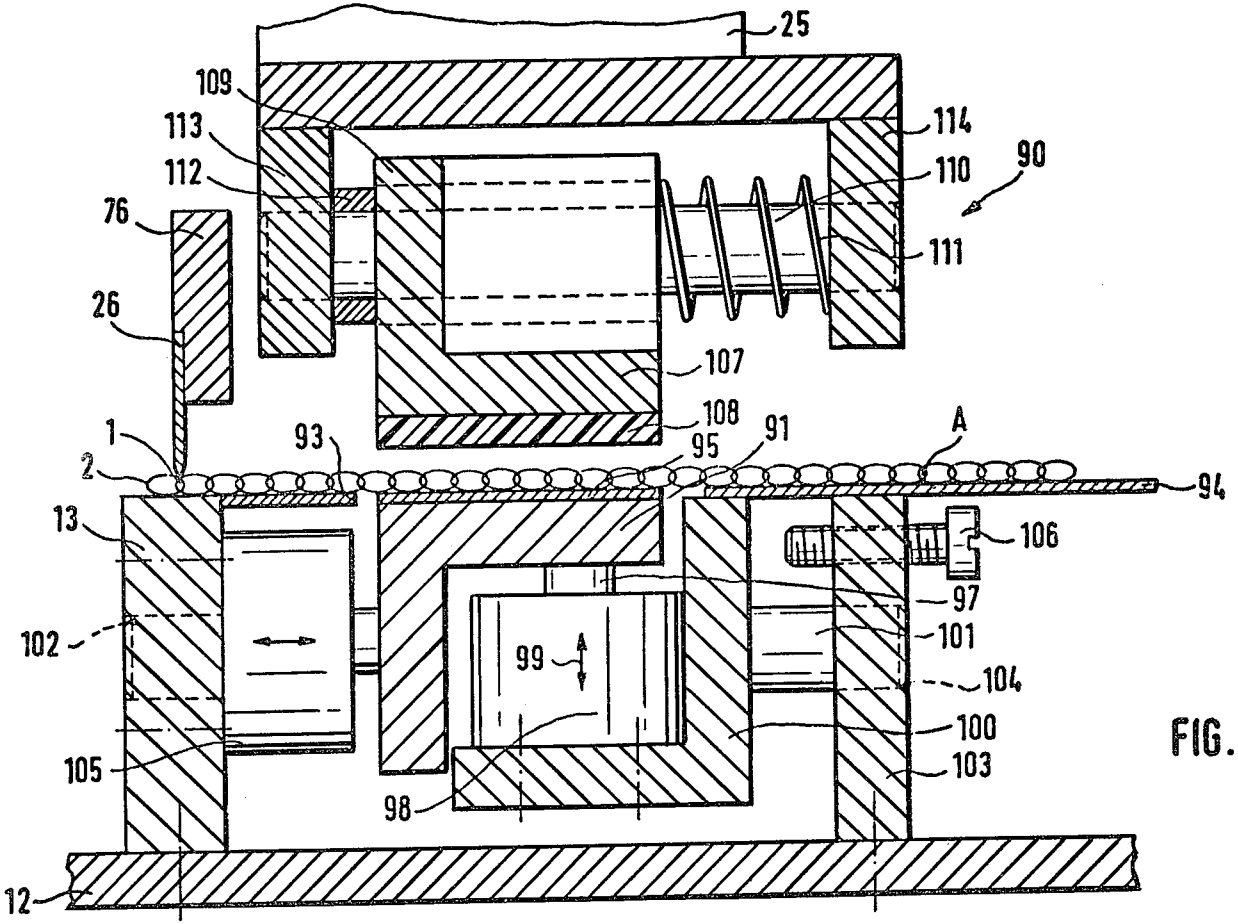

Details of the transport device 90 can be seen in FIG. 7. On the jointer which is mounted on the work table plate 12, the existing helix 0, the last added first helix 1 and the further added helix 2 can be seen which are joined into a face structure A. The position of the alignment knife 26 between adjacent helixes can be clearly seen.

The lower transport piece 91 of transport device 90 is disposed on an intermediary plate 93 behind jointer 13 and in front of a discharge plate 94 for the face structure A. The pneumatically actuated transport piece 91 is provided with a transport face 95 and a pressure face 108 of the counter retainer 107 being opposite of the transport face. The transport piece 91 is connected with a drive cylinder 98 by means of a rod 97, whereby the drive cylinder communicates an upward and downward movement to the transport piece in accordance with arrow 99. The drive cylinder 98 is mounted on a sliding piece 100 which can slide on a slide rod 101 which is mounted in apertures 102 of the jointer 13 and 104 of rear wall 103. The lateral reciprocal movement of the slide piece 100 is affected by a drive cylinder 105 which is pneumatically switchable. The reciprocating movement of the slide piece 101 can be limited or adjusted, respectively, by means of a limiting screw 106.

The counter retainer 107 with its pressure face 108 is coupled on a slide piece 109 which is slideably mounted on a slide rod 110 in a reciprocating movement. On the one side of the slide piece 109 a limit piece 112 is provided and on the other side a spring 111. The slide rod 110 is mounted in supports 113 or 114, respectively, below bridge 25.

The drive cylinders 98 or 105, respectively, can be so synchronized by the triggers triggered by the joint carriage in that the transport face 95 in conjunction with the pressure face 108 can transport the face structure A by one insert wire distance after a finished joining operation.

In the hitherto described embodiment, one or a plurality of alignment knives 26 must be provided for retaining the face structrue A on the jointer 13, and the transport device 90 must be provided for transporting the face structure A by about one insert wire distance. In smaller joining devices the plurality of mounted pieces 91 or 109, respectively, may reach over the total width of the work table. However, in wide operating tables a plurality of slide pieces are distributed over the total width of the work table which are in affective connection with each other, either pneumatically, or electrically, so as to affect an even transporting of the face structure A, after a finished joining operation.

Figures 8, 9:
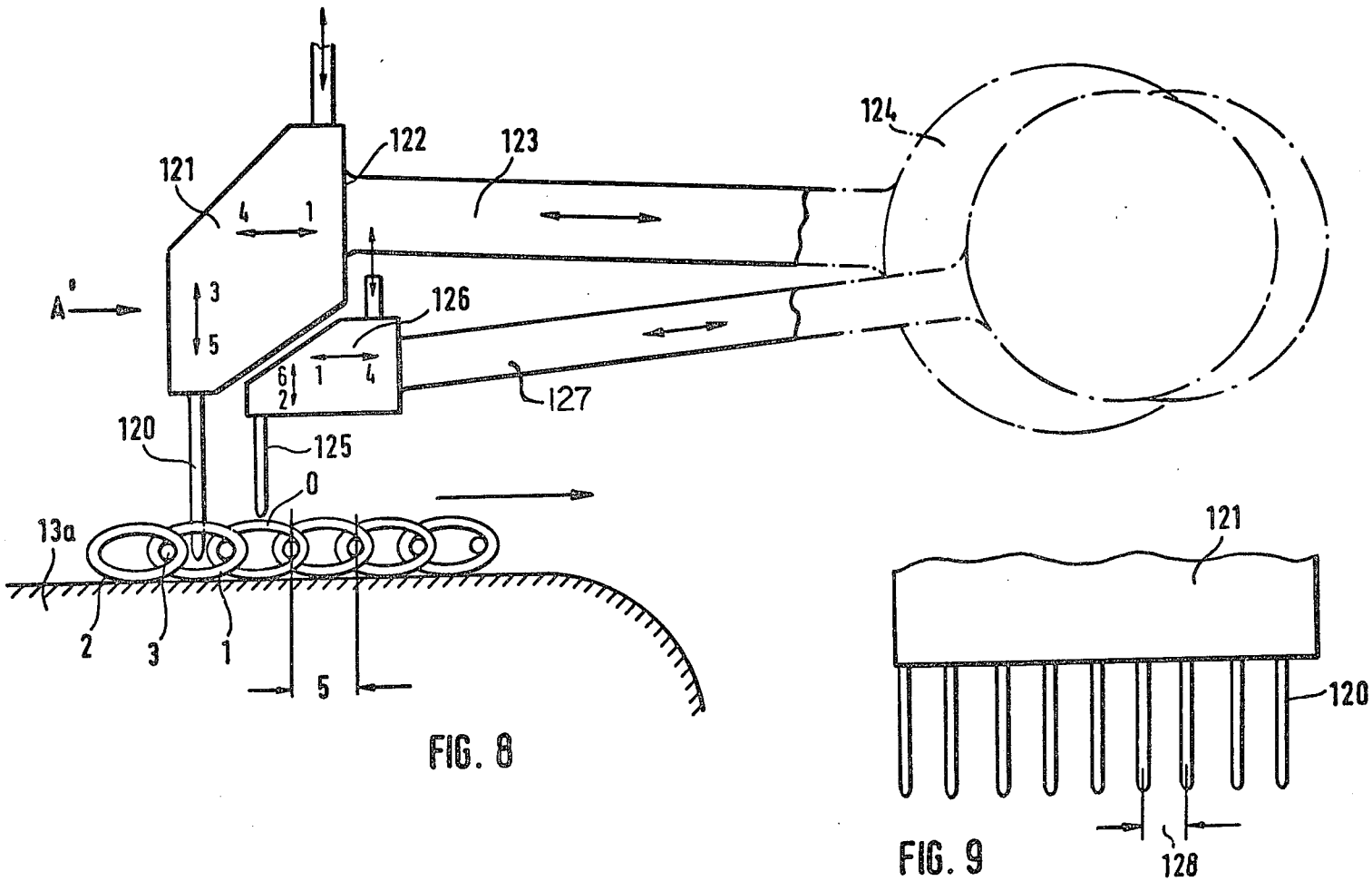

The FIGS. 8 and 9 show details of a combined retaining and transport device for face structure A. On a jointer table **13*a* which is differently designed than the jointer 13, the face structure is shown, which on the left side shows the existing helix 0, the last addded first helix 1 and the further added second helix 2. The insert wires 3, as already explained, are indicated in the overlapping areas. After a finished joining operation, the face structure A is further transported by one insert wire distance 5 (according to FIG. 8, to the right). The combined retaining and transporting device essentially consists of the two pin bars 121 and 126 on which the arresting transport pins 120,125** are mounted.

FIG. 9 shows the pin bar 121 in the direction of arrow A of FIG. 8. Steel pins are used for the pins 120 or 125, respectively, which are coated with lead. The pins have a pin distance 128.

A plurality of pin bars 121,126 are provided adjacent to each other across the width of the joining table **13*a*, so that assurance is given that the face structure A can be transported by one insert wire distance 5**, after the joining operation is finished.

In the shown embodiment, the pin bars 121,126 are connected by means of connecting rods 123 or 127, respectively, to drive excenter 124. One of these drive excenters is connected by means of a connecting rod 123 with the connecting rod connection 122. For simmplification purposes this connection from the connecting rod 127 is not shown in detail.

The reciprocating movement of the pin bars 121 and 126 is carried out by the excenters 124, whereby the upward and downward movement can be performed by mechanical guiding or pneumatically. For simplication purposes these guides are shown only schematically.

Arrows are mounted on the pin bars 121 and 126 for characterizing the movement paths, whereby numbers are provided on the arrow tips. With the aid of these characterizations the following movement occurs in accordance with the pattern:

| | |
|---|---|
| Cycle 1 | pin bar 121, back |
| | pin bar 126, forward |
| Cycle 2 | pin bar 126, lower |
| Cycle 3 | pin bar 121, lifting |
| | add new helix (joining cycle) |
| Cycle 4 | pin bar 126, back |
| | pin bar 121, forward |
| Cycle 5 | pin bar 121, lower |
| Cycle 6 | pin bar 126, lifting |

Naturally, the movements of the pin bars 121 and 126 are coordinated with the movements of the joint carriage. This coordination may be performed by an electronic circuit, but also by pneumatical switches which are actuated by the joining carriage.

Figure 10:
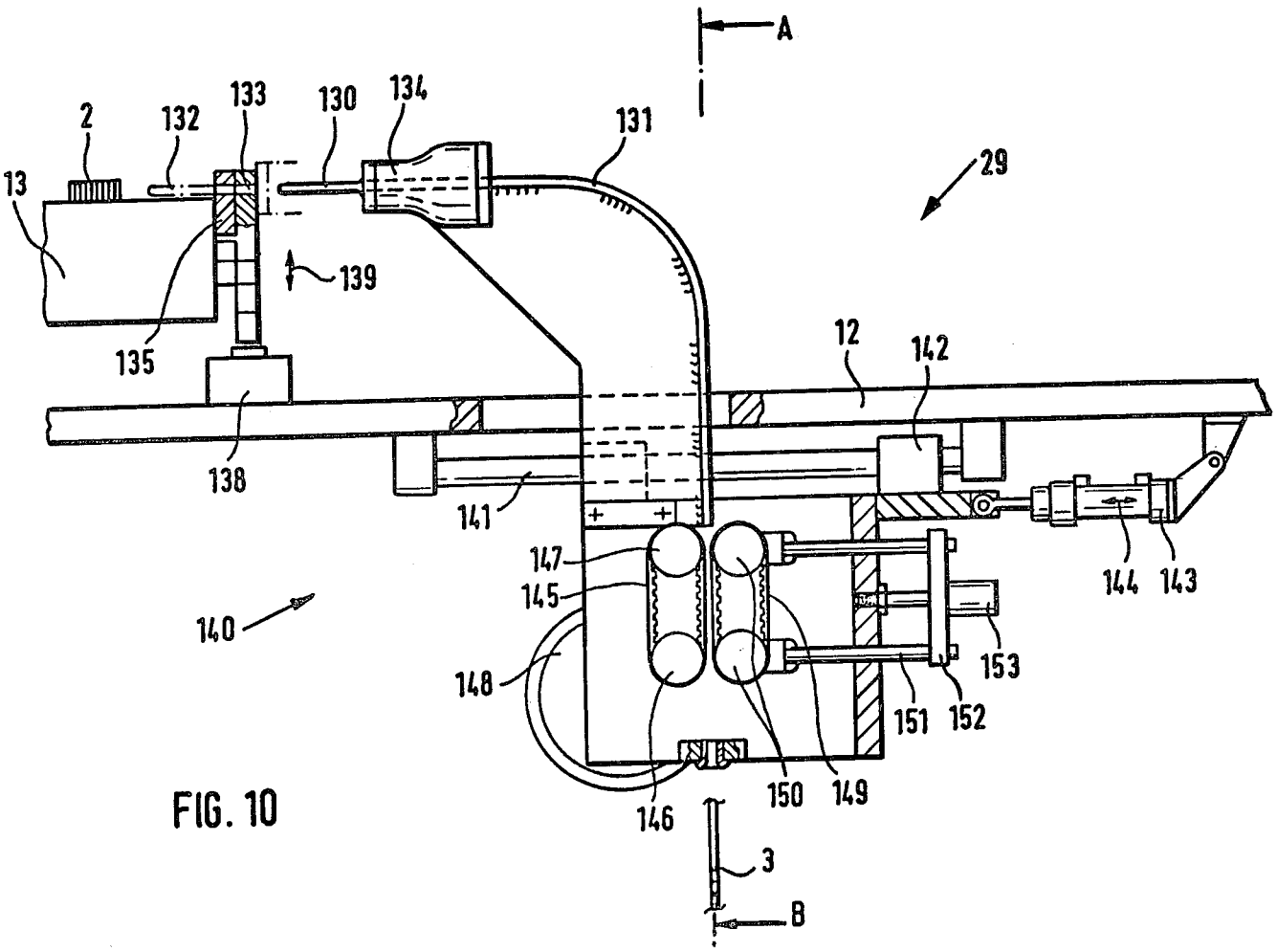

FIG. 10 shows details of a wire insert device 29 which is provided below the work table plate 12 on which the jointer 13 is mounted or the jointing table **13*a***, respectively.

The insert wire 3, at first is in a supply drum which is not shown (see reference numeral 28 in FIG. 4) and is fed from the wire guide 131 into the overlapping area between two adjacent helixes, of which only helix 2 is shown. The wire insert device 29 which is shown in detail in FIG. 10, for example, is the same as the one shown on the right side of FIG. 4. A wire guide 131 can be guided into the dash dot indicated operating position 132. Thereby, the wire which exits from a discharge opening 130 is guided through a wire insert opening 133 of an aperture knife 135 to the left, so that the tip of the insert wire is guided to the beginning of the overlapping area.

In order to perform this reciprocating movement of the wire insert opening, the wire insert opening is mounted beneath the work table plate 12 on a sliding rod 141 by means of slide feet 142.

The aperture knife 135 is under the influence of a pneumatic drive cylinder 138 through which it is moved upwardly or downwardly corresponding to arrow 139 to cut the insert wire.

In order to assure an interference free insertion of the insert wire 3 into the often very long overlapping area 4, an ultrasound oscillator 134 may be provided in a particular embodiment, whereby this oscillator brings the insert wire 3 into ultra high oscillations during the insertion operation which facilitates the insertion considerably.

The wire insert device 29 which with its slide feet 142 is moveably mounted on the slide rod 141 is coupled to a pneumatic drive cylinder 143, which in accordance with the directional arrow 144 performs a reciprocal movement on command.

The transport device itself is provided with an advance drive belt 145 which is guided over a drive roller 146 and a roller 147. The drive roller is in positive connection with a motor 148, the rotational speed of which is controllable.

Opposite of the advance drive belt 145 a counter pressure belt 149 is provided which runs on rollers 150 which are connected with a support plate 152 by means of guide rods 151, whereby the support plate is in active connection with a pneumatic pressure cylinder 153.

Figure 11:
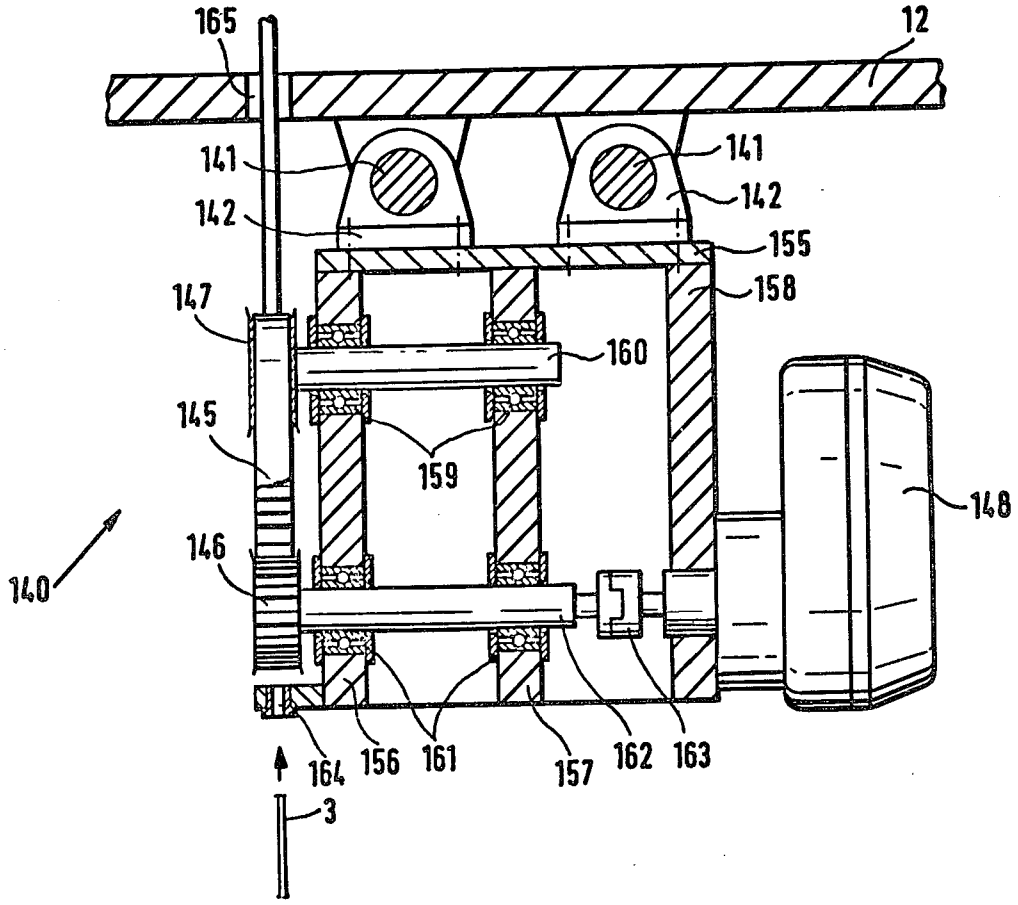

Detail of the wire transport device 140 may be seen in FIG. 11, which is a sectional view along line A B of FIG. 10. Below the work table plate 12 the slide rods 141 can be seen on which the wire transport device 140 is slidingly mounted by means of slide feet 142. The slide feet 142 are connected on an upper wall 155 of the wire transport device. It is provided with a front wall 156, a center wall 157, as well as a rear wall 158. A running shaft 160 is mounted in bearings 159 in the front wall 156 and the center wall 157, whereby the roller 147 is mounted on the left side on the running shaft.

A drive shaft 162 is guided through bearing 161 and is connected to the drive roller 146. The drive shaft 162 is in active connection with motor 148 by means of a coupling 163.

The insert wire 3 is drawn off the supply roll and is inserted through a wire feeding opening 164 into the intermediary space between the advance belt 145 and the counter pressure belt 149. This is pressed by the pneumatic pressure cylinder 153 in such a manner against the advance drive belt 145 that the insert wire 3 is guided with the desired speed through the wire guide 131. The wire exits through a wire throughput guide 165 and through the work table plate 12.

The individual switches within the joint device may be controlled pneumatically, electromagnetically or mechanically and can be so triggered. The aforementioned embodiments are pneumatically driven.

Without changing the gist of the invention, a joint carriage 16 may be designed with two oppositely arranged joining tools 42 for joining two face structures A during one operating step. Every person skilled in that art would be able to expand the single joining device in accordance with the invention to a double joining device in accordance with the shown and described device without using inventive ingenuity.

Instead of the reciprocating movement of the joint carriage in front of the jointer table or the jointer, the joint carriage can also be guided around the work table. In this embodiment of the inventive device a joining operation would be performed on each side of the work table. The changes which would be required for the described joint device will not be described in detail.

Instead of the joining tool formed as the joining wheel 42, other tools may be used, for example, such joining tools 42 which are designed as sliding wheels 42' mounted on the end of a yielding arm **42*b*. Advantagously two each sliding wheels 42 are mounted on two each yielding arms 42*b*** between the opposite ends of the discharge conduits in the joint carriage.

The jacket face of the slide wheels is designed in an advantageous manner like the running face of the joining tool 42.

The mode of operation of the combined arresting and transporting device has been already explained in conjunction with FIGS. 8 and 9. A further explanation of the mode of operation is not required, since it is explained by the claims, the Figs., as well as the description for the Figs.

FIGS. 12 and 13 show, schematically indicated, embodiments of a jacket **42*a*** of a joining tool.

It will be understood that each of the elements described above, or two or more together, may also find a useful application in other types of constuctions differing from the types described above.

While the invention has been illustrated and described as embodied in a device for assembling helixes, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of assembling helixes into face structures, comprising the steps of providing an initial helix which is stretched and retained on a work table, and a first helix which is attached to the initial helix;

inserting into the first helix a prestretched second helix by means of a joining tool and from a discharge conduit so that the second helix exits from the discharge conduit at an acute angle with respect to the first helix and moved along the latter;

connecting the second helix with the first helix by inserting an insert wire into the overlapping areas between the head arches of the first and second helixes; and displacing the thus finished face structure by a predetermined distance between insert wires in a timed sequence before a subsequent such inserting step for a further helix to be inserted into the second helix.

2. A method as defined in claim 1, wherein said providing and inserting steps include using helixes of a material selected from the group consisting of a metal wire and a plastic wire, said connecting step including using insert wires of a material selected from the group consisting of metal and plastic.

3. A method as defined in claim 1, wherein said providing and inserting steps include reciprocating the joining tool and using two such discharge conduits so that the first and second helixes which are left and right helixes are supplied from the respective discharge conduits.

4. A method as defined in claim 1, wherein said inserting step includes retaining the beginning of the second helix by the first helix, and moving the joining tool with a transporting speed and exiting the second helix with feeding speed which are synchronized with one another so that the stretching of the second helix is obtained.

5. A device for assembling helixes into face structures, comprising a work table for arranging an initial prestretched helix and a first helix attached to the initial helix;

a discharge conduit for supplying a second helix to be joined with the first helix;

a joining tool inserting the prestretched second helix exiting from said discharge conduit at an acute angle with respect to the first helix with movement along the latter;

means for connecting the second helix with the first helix and including an insert wire insertable into overlapping areas between head arches of the first and second helixes; and means for transporting the thus finished face structure by a distance between insert wires in a timed sequence before inserting of a further helix into the second helix.

6. A device as defined in claim 4; and further comprising a jointing element arranged on said work table, and a carriage carrying said joining tool and said discharge conduit and reciprocably movable above said work table across its total width so that a distance between a lower area of said joining tool and a jointing element is somewhat smaller than the cross-section of the second helix, a supply roller and a wire insert device arranged for inserting the insert wire into the overlapping areas between the head arches of the first and and second helixes, said transporting means including a lower pneumatically actuatable transport piece and an upper counter retainer.

7. A device as defined in claim 4; and further comprising a jointing element arranged on said work table, a second such joining tool and a second such discharge conduit for joining two such face structures, and carriage which carries said first-mentioned and second joining tools and said first-mentioned and second discharge conduits, said carriage being reciprocably movable above said work table across its total width so that a distance between a lower area of the joining tools and the jointing element is somewhat smaller than the cross-section of the second helix, a supply roller and a wire insert device arranged for inserting the insert wire into the overlapping areas between the head arches of the first and second helixes, said transporting means including a lower pneumatically actuatable transport piece and an upper counter retainer.

8. A device as defined in claim 4; and further comprising a jointing element arranged on said work table, an endless chain running around said work table, two such joining tools and two such discharge conduits, and two carriages each provided with one of said joining tools and one of said discharge conduits and mounted on said endless chain, so that the distance between a lower area of said joining tools and a jointing element is somewhat lower than the cross-section of the second helix, a supply roller and a wire insert device arranged for inserting the insert wire into the overlapping areas between the head arches of the first and second helixes, said transporting means including a lower pneumatically actuatable transport piece and an upper counter retainer.

9. A device as defined in claim 8; and further comprising supply containers mounted on said carriages for supplying said second helixes.

10. A device as defined in claim 9, wherein said discharge conduit exits from a respective one of said carriages at an acute angle, and a supply conduit and a roller coupling each of said supply containers with said discharge conduit.

11. A device as defined in claim 10, wherein said carriage has a working wall and a lower edge, said supply conduits are guided in said working wall of said carriage at both sides of said joining tool, and combined on said lower edge of said carriage below said joining tool.

12. A device as defined in claim 11, wherein each discharge conduit has an opening, each of said supply conduits being provided with a cutting tool which is spaced from the opening of a respective one of said discharge conduits by the length of an overrun of a working stroke.

13. A device as defined in claim 7, wherein said discharge conduit have a common discharge area, said joining tool being formed as a joining wheel with an outer face which is formed as a joining edge and extends into said common discharge area of said discharge conduits; and further comprising a drive shaft on which said joining wheel is rotatably mounted so that said outer face of said joining wheel extends into said common discharge area of said discharge conduits.

14. A device as defined in claim 13, wherein said outer face of said joining wheel is smooth.

15. A device as defined in claim 13, wherein said outer face of said joining wheel which is indented toward said drive shaft.

16. A device as defined in claim 15, wherein said outer face of said joining wheel is provided with a plurality of serrations.

17. A device as defined in claim 15, wherein said outer face of said joining wheel is provided with a plurality of points.

18. A device as defined in claim 15, wherein said outer face of said joining wheel is provided with a plurality of teeth.

19. A device as defined in claim 6, wherein said work table has a plate, two parallel sliding rods arranged on said plate, a support located between said sliding rods, and a gear rod mounted below said carriage, said carriage having a drive motor and a drive gear which is driven by said drive motor and engages with said gear rod.

20. A device as defined in claim 10, wherein said supply conduits have arresting knives, the arresting knife of one of said supply conduits and the roller of the other of said supply conduits are alternately actuated.

21. A device as defined in claim 6, wherein said supply roller and said wire insert device are adjustable on said work table in the area of an overrun of a working stroke.

22. A device as defined in claim 21; and further comprising an exactly positionable wire guide for inserting the insert wire into the overlapping area of the first and second helixes.

23. A device as defined in claim 21; and further comprising an ultrasound oscillator arranged to bring the insert wire into high frequency oscillations before its introduction into the overlapping area.

24. A device as defined in claim 23, wherein said wire guide is adjustable in a longitudinal direction and has an output, said ultrasound oscillator being located at said output of said wire guide.

25. A device as defined in claim 21; and further comprising an aperture knife and a wire output opening forming a part of said aperture knife.

26. A device as defined in claim 21; and further comprising wire feeding means having an advance belt, a motor driving said advance belt and a counter pressure belt mounted on rollers so that the insert wire is fed between said belts.

27. A device as defined in claim 6; and further comprising means for retaining and aligning said helixes placed on said jointing element and extending across the entire width of said work table.

28. A device as defined in claim 27, wherein said retaining and aligning means includes an aligning knife extending across the entire length of said work table for retaining and aligning said helixes.

29. A device as defined in claim 27, wherein said retaining and aligning device includes a plurality of aligning knives extending across the entire length of said work table for retaining and aligning said helixes.

30. A device as defined in claim 29, wherein said aligning knives are guided vertically towards said work table; and further comprising springs urging said aligning knives vertically toward said work table.

31. A device as defined in claim 28, and further comprising a pneumatic stroke drive connected with said aligning knife.

32. A device as defined in claim 28, wherein said aligning knife is arranged so as to engage said initial helix and the latest inserted helix during joining.

33. A device as defined in claim 6; and further comprising an intermediate plate and a discharge plate, said lower pneumatically actuated transport piece being provided with a transport face located in an opening in a plane of said intermediate plate and said discharge plate.

34. A device as defined in claim 33; and further comprising a slide rod, a slide piece mounted on said slide rod in a transport direction, a pneumatic cylinder driving said slide piece, a pneumatic stroke drive cylinder mounted on said slide piece, and a rod coupling said transport piece to said pneumatic stroke drive cylinder.

35. A device as defined in claim 34; and further comprising a slide rod, a spring, and a sliding counter retainer having a pressure face and yieldingly mounted in said transport direction on said slide rod against a force of said spring.

36. A device as defined in claim 34; and further comprising a limiting screw for transport movement of said slide piece.

37. A device as defined in claim 6; and further comprising a pneumatically driven yielding pin bar means extending across the entire width of said work table and arranged for aligning, retaining and transporting the face structure during and after joining.

38. A device as defined in claim 37, wherein said pin bar means includes a plurality of adjacent pin bars which are pneumatically driven in an alternating manner and an eccentric and connecting rod via which said pin bars are driven.

39. A device as defined in claim 6; and further comprising means for aligning, retaining and transporting the face structure, said means being driven pneumatically by means of compressed air, and triggers actuated by said carriage and switching the compressed air.

40. A device as defined in claim 6, wherein said joining tool is formed as a sliding wheel mounted on the end of a yielding arm.

41. A device as defined in claim 40, wherein two such sliding wheels are arranged on each yielding arm in said carriage between opposite ends of said discharge conduits.

42. A device as defined in claim 40, wherein said sliding wheel has a smooth running face.

43. A device as defined in claim 40, wherein said sliding wheel has an indented running face.

* * * * *